US005681249A

United States Patent [19]

Endelman

[11] Patent Number: 5,681,249

[45] Date of Patent: Oct. 28, 1997

[54] CONVERTIBLE EXERCISE APPARATUS

[76] Inventor: Ken Endelman, 7500 14th Ave., Suite 23, Sacramento, Calif. 95820-3539

[21] Appl. No.: 564,778

[22] Filed: Nov. 29, 1995

[51] Int. Cl.[6] ..... A63B 21/04

[52] U.S. Cl. ..... 482/142; 482/129; 482/133; 482/139

[58] Field of Search ..... 482/72, 95, 96, 482/101, 122, 123, 129, 130, 132–135, 142

[56] References Cited

U.S. PATENT DOCUMENTS

| | | | |
|---|---|---|---|
| 339,638 | 4/1886 | Goldie | 482/96 |
| 1,621,477 | 3/1927 | Pilates . | |
| 1,738,987 | 12/1929 | Dattilo | 482/130 |
| 2,733,922 | 2/1956 | Diego | 482/96 |
| 3,770,267 | 11/1973 | McCarthy | 482/130 |
| 3,892,404 | 7/1975 | Martucci | 482/96 |
| 4,084,815 | 4/1978 | Flannery | 482/142 |
| 4,383,684 | 5/1983 | Schliep | 482/96 |
| 4,768,776 | 9/1988 | Giannotti | 482/95 |
| 4,974,832 | 12/1990 | Dalebout | 482/142 |
| 5,024,214 | 6/1991 | Hayes | 482/95 |
| 5,066,005 | 11/1991 | Luecke . | |
| 5,263,913 | 11/1993 | Boren | 482/96 |
| 5,338,278 | 8/1994 | Endelman . | |

FOREIGN PATENT DOCUMENTS

| | | | |
|---|---|---|---|
| 1470421 | 2/1967 | France | 482/142 |
| 2625907 | 7/1989 | France | 482/130 |
| 2944599 | 5/1981 | Germany | 482/133 |

*Primary Examiner*—Richard J. Apley
*Assistant Examiner*—Victor K. Hwang
*Attorney, Agent, or Firm*—John R. Wahl; Holland & Hart LLP

[57] ABSTRACT

The exercise apparatus in accordance with the present invention includes a wheeled carriage having a generally flat top surface movably mounted on a generally rectangular frame. The carriage includes a removable shoulder stop and head rest assembly mounted on the carriage at one end thereof for preventing sliding of the user's body from the carriage. This shoulder stop and head rest assembly is removed to convert the apparatus into a flat table for stationary exercises. A first generally flat, padded, table top member is positionable between the carriage and one end of the frame in the plane of the top surface of the carriage. A second generally flat, padded table member is positionable between the carriage and the other end of the frame in the plane of the top of the carriage when the removable shoulder and head rest assembly is removed to prevent the carriage from moving and form a generally flat stationary table surface.

9 Claims, 3 Drawing Sheets

CONVERTIBLE EXERCISE APPARATUS

CROSS-REFERENCE TO RELATED APPLICATIONS

This application is related to my U.S. Pat. No. 5,338,278 and my prior filed application Ser. No. 08/225,502, filed on Apr. 11, 1994 which is a continuation of Ser. No. 07/940,495, filed on Sep. 4, 1992.

BACKGROUND OF THE INVENTION

1. Field of the Invention

This invention relates generally to exercise equipment and more particularly to the type of apparatus which includes a movable carriage for supporting a major portion of a user's body.

2. Description of the Related Art

Joseph H. Pilates, in U.S. Pat. No. 1,621,477, originally developed the concept of using a wheeled platform carriage connected to a resistance device such as a set of weights in conjunction with a stationary frame to provide a variable resistance against which a user could push with his/her feet or pull with the arms while in a sitting or recumbent position in order to exercise the major muscle groups of the user's legs and/or arms. Since that time, many changes and improvements in the design of such an apparatus were developed by Joseph Pilates, and more recently, have been evolved by his students and others. U.S. Pat. No. 5,066,005 and my U.S. Pat. No. 5,338,278 are representative of the current state of evolutionary development of these changes that have taken place since 1927.

These two patents each disclose an apparatus which includes a wheeled platform carriage which rides on a rectangular frame. The carriage is connected to a series of parallel springs which are in turn connected to a foot end of the rectangular frame. The carriage rides on parallel rails or track mounted to the inside of the longer sides of the rectangular frame. This carriage includes a pair of spaced, padded, upright shoulder stops and a head rest at one end to support the shoulders and head of the user when he/she is reclined on the carriage. An adjustable upright foot bar, foot board or foot rest against which the user places her feet is removably mounted to the foot end of the rectangular frame to which the springs are attached. The user can then push against the foot rest to move the carriage along the track away from the foot rest against spring tension to exercise the leg and foot muscle groups in accordance with prescribed movement routines.

A pair of spaced pulleys is mounted at the head end of the frame. Alternatively, there may be spaced upright members fixed to the head end which each support one or more pulleys. A pair of straps or cords pass through the pulleys with one end of each cord adjustably fastened to the wheeled carriage. The other end of each cord includes a handle or loop for the user to grasp. When the user lies or sits on the carriage and grasps the handle or loops and pulls on the cords, the carriage will move along the track toward the head end of the frame against the spring tension so that the user can exercise his or her arms and upper body in accordance with other prescribed movement routines.

My U.S. Pat. No. 5,338,276 discloses several novel foot rest arrangements and adjustable headrest assemblies for a wheeled carriage exercise apparatus such as the apparatus above described. U.S. Pat. No. 5,066,005 discloses other foot rest and, head end upright support and pulley configurations for this type of exercise apparatus. The user of the apparatus of the type disclosed in these patents usually lies on the carriage, or stands or sits on the carriage to perform particular exercises.

There are some exercises, however, which Joe Pilates originally devised and others have built upon and have continued to develop and refine or which have evolved from other sources which are best performed on a stationary surface such as a flat table or on the floor. The exercise apparatus disclosed in the patents above described cannot be used for these exercises since the carriage is not stationary. Further, the shoulder stops project above the carriage surface. Therefore additional floor space or an additional flat table must be made available to the user. The surface must also be covered with a cushioning material or pad so that the user can be relatively comfortable while performing these stationary or floor exercises.

In most professional exercise studios, physical therapy clinics, and home studios space is almost always at a premium. Therefore there is a need for an exercise apparatus which utilizes a wheeled carriage as above described which can be quickly and conveniently converted to and from a stationary exercise table for performing the above mentioned stationary exercises.

SUMMARY OF THE INVENTION

The present invention is directed to meeting the above identified needs. The exercise apparatus in accordance with the present invention comprises, in combination, a wheeled carriage having a generally flat top surface movably mounted on a generally rectangular frame. The carriage includes a removable shoulder stop and head rest assembly mounted on the carriage at one end thereof for preventing sliding of the user's body from the carriage. This shoulder stop and head rest assembly is removed to convert the apparatus into a flat table for stationary exercises.

A first generally flat, padded, table member is positionable between the carriage and one end of the frame in the plane of the top surface of the carriage. A second generally flat, padded table member is positionable between the carriage and the other end of the frame in the plane of the top of the carriage when the removable shoulder and head rest assembly is removed so as to form a generally uniform flat table surface. The table members are generally rectangular plate shaped bodies, each with a padded upper surface, so that when positioned between the ends of the frame and on either side of the carriage, they wedge the carriage in a fixed position so that it cannot move.

The exercise table thus formed is conveniently converted back into the exercise apparatus with a movable carriage by simply removing the two flat support members and reattaching the shoulder stop and head rest assembly to the head end of the movable carriage. The flat table members can be conveniently stored underneath the frame so that the convertible exercise apparatus in accordance with the present invention can replace a separate exercise table and eliminate the need for additional floor space which has been conventionally required for at least the past 50 years. These and other features, advantages and objects of the invention will become more apparent from a reading of the following detailed description when taken in conjunction with the accompanying drawing.

DETAILED DESCRIPTION OF THE INVENTION

Figure 1:
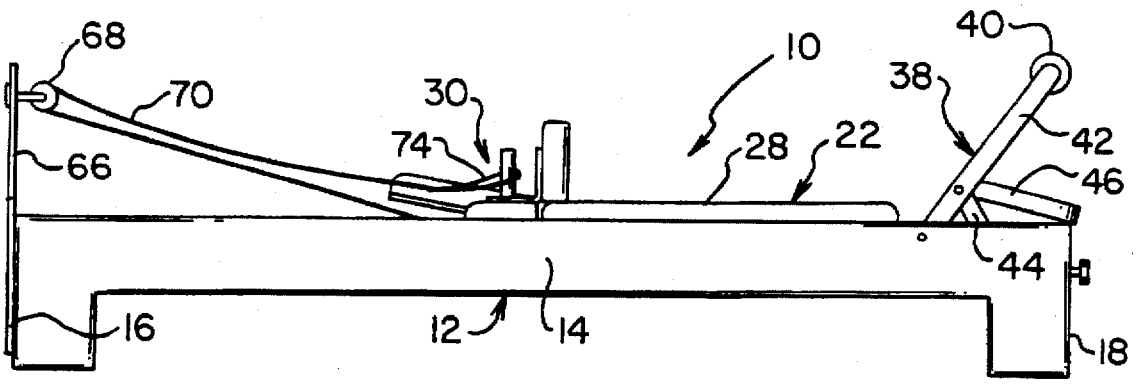
FIG. 1 is a side view of an exercise apparatus in accordance with the present invention with upright arm cord pulley supports installed.

Referring now to the drawing, a convertible exercise apparatus 10 in accordance with a preferred embodiment of the invention is shown in FIGS. 1 to 7. Referring first to a side view in FIG. 1 and a perspective head end view in FIG. 2, the exercise apparatus 10 includes a generally rectangular frame 12 which has spaced, parallel long side walls 14. The head ends of the side walls 14 are joined by a head end wall 16 and the foot ends of the side walls 14 are joined by a foot end wall 18. Each of the side walls 14 carries an inside horizontal rail 20 preferably made of aluminum angle bar stock having an "L " shaped cross section. The rails 20 are bolted or screwed to the inside surface of the side walls 14 to form a parallel horizontal spaced track upon which a wheeled carriage 22 rides.

Figure 3:
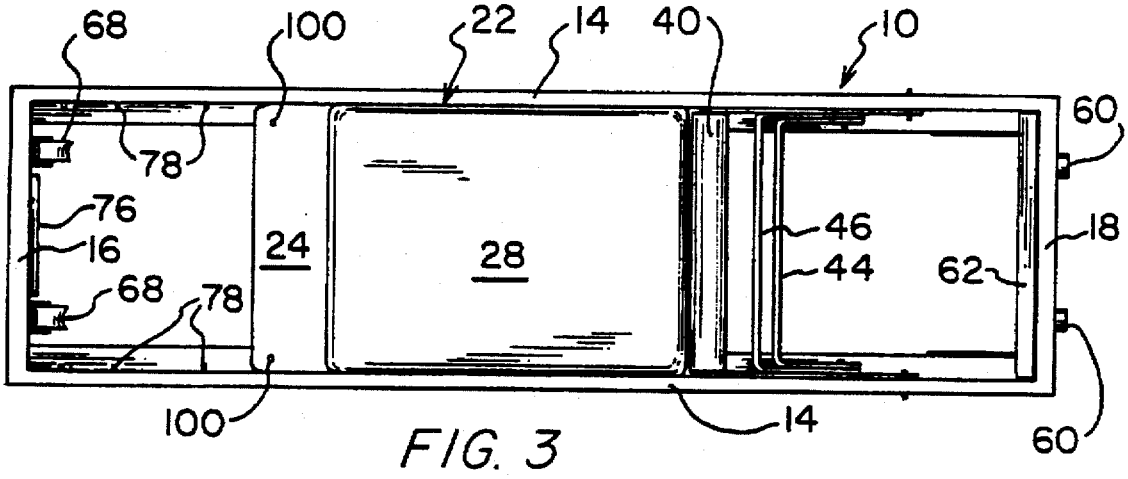
FIG. 3 is a plan view of the apparatus shown in FIG. 2 with the foot rest folded down into the frame and the arm cords and the shoulder stop and head rest assembly removed.
Figure 4:
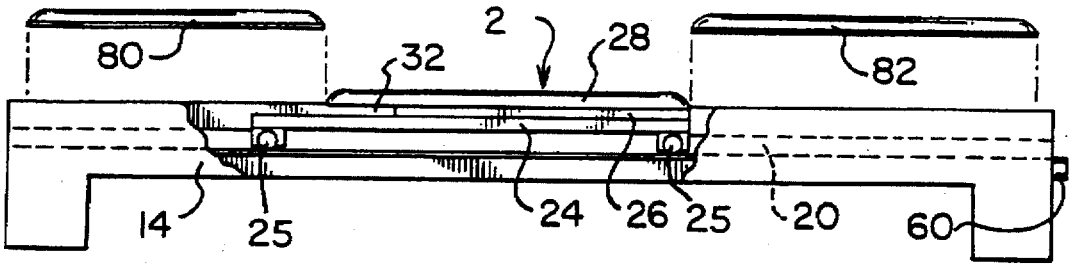
FIG. 4 is a side view of the apparatus shown in FIG. 3 with the padded table top members spaced above their installed position on either side of the carriage.

The wheeled carriage 22 comprises a flat rectangular base plate 24. As is best shown in FIGS. 3 and 4, the base plate 24 has two pairs of roller wheels 25 mounted to its underside at its corners. These wheels 25 ride along the rails 20 to constrain movement of the carriage 22 forward and backward between the head and foot end walls of the frame 12 as will be subsequently described. Fastened on top of the base plate 24 is a spacer 26 and a padded rectangular carriage top platform 28 The padded carriage top platform 28 is shorter than the rectangular plate 24 to accommodate a removable shoulder stop and head rest assembly 30 at the head end of the plate 24, shown installed in FIGS. 1 and 2, and separately shown in FIG. 7. The spacer 26 forms a horizontal slot 32 between the base plate 24 and the carriage top platform 28. The slot 32 receives and captures a tail portion 34 of the assembly 30. The assembly 30 is removably fastened in place on the carriage 22 via fasteners such as bolt and threaded hand knob assemblies 36 as is shown in FIG. 2.

Figure 2:
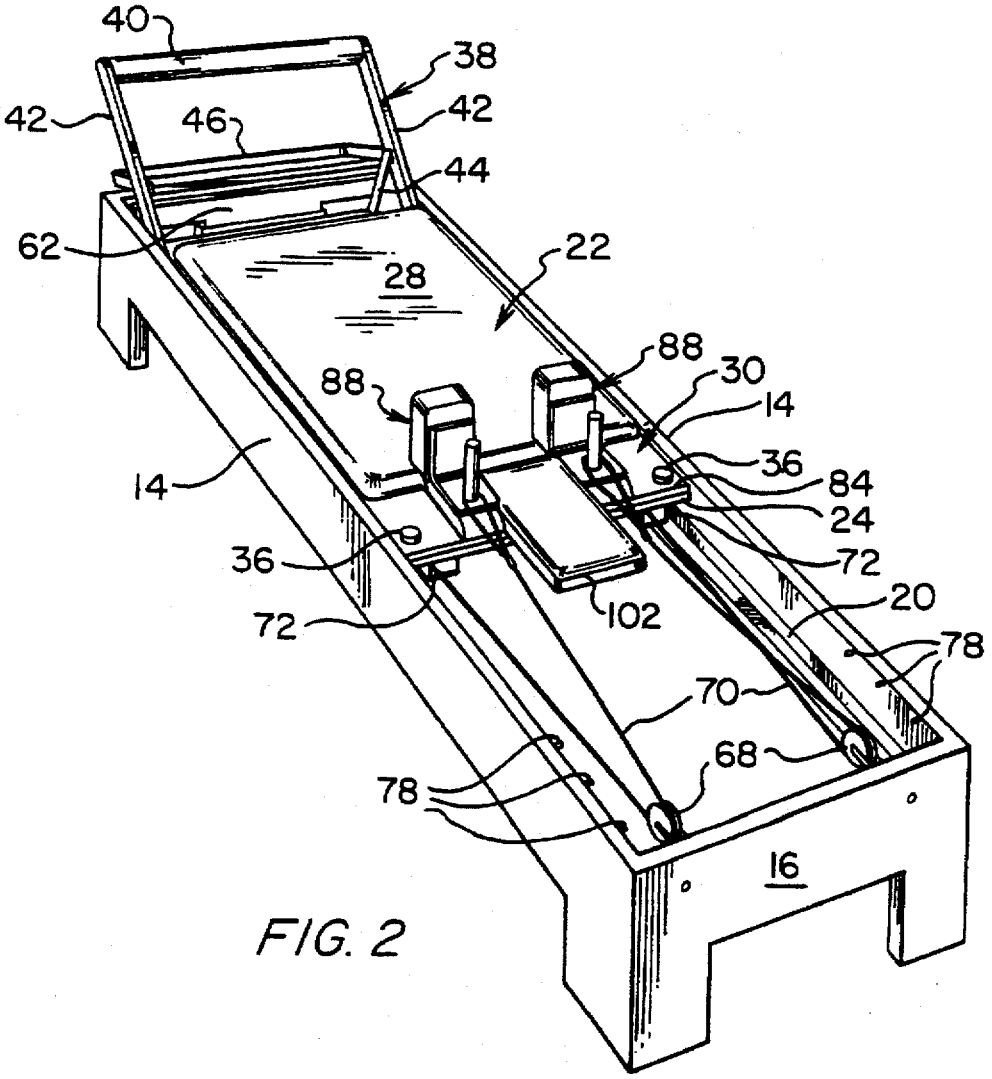
FIG. 2 is a perspective view of the exercise apparatus in accordance with the invention from the head end with the upright arm cord pulley supports removed and the arm cords installed on pulleys mounted to the head end of the frame.
Figure 6:
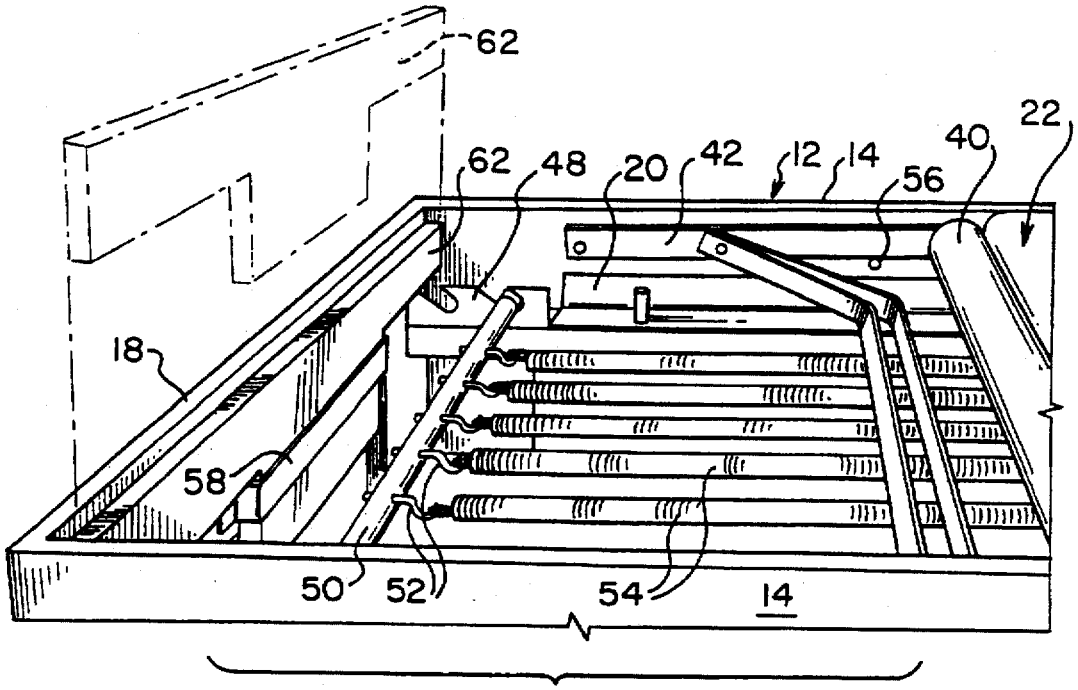
FIG. 6 is an enlarged perspective view of the foot end portion of the exercise apparatus in accordance with the invention as shown in FIG. 3 with a foot end table top member support board installed in the foot board support bracket.

The exercise apparatus 10 includes an adjustable foot support assembly 38 best shown in FIGS. 1, 2, and 6. The foot support assembly 38 preferably has a padded horizontal bar 40 which is adjustably positioned above the frame 12 via support members 42 which each have one end pivotally mounted to the inside of one of the frame side walls 14. The support members 42 are positioned at a location spaced from the end wall 18 so that the support members 42 and the horizontal bar 40 may be folded down parallel with the upper edge of the frame 12 as is shown in FIG. 6.

The foot support assembly 38 further includes a pair of "U" shaped brace members 44 and 46 which have their ends pivotally fastened to the support members 42 These brace members 44 and 46 are of different lengths so that they can position the horizontal bar 40 at different heights above the frame 12 and nest together between the support members 42 and the horizontal foot bar 40 in the folded position shown in FIG. 6.

At the foot end of each rail 20 is a spring support bracket 48. This spring support bracket has two slots to receive one end of a spring support rod 50. One of the support brackets 48 is shown in FIG. 6 holding one end of the spring support rod 50. The other end of the spring support rod 50 and the other support bracket 48 is hidden from view. The spring support rod 50 carries a plurality of spaced hooks 52 to which one end of a spring 54 can be hooked. The other ends of the springs 54 are each fastened to the underside of the foot end of the carriage base plate 24. In FIG. 6, all springs are shown attached to hooks, for illustrative purposes only. The user of the apparatus of the invention can vary the spring tension applied to the carriage 22 during different exercises by changing the combination of the springs 54 attached to the hooks 52 and/or moving the support rod 50 to the other slot in the support brackets 48.

In FIG. 6, the foot bar assembly is shown folded toward the foot end of the carriage 22. The support members 42 rest upon stop pins 56 in this position so that the horizontal bar 40 is positioned slightly beneath the upper edge of the side walls 14. In this position, spring tension can be used to hold the carriage 22 against the horizontal bar 40.

The foot end wall 18 carries a removable foot board support bracket 58. This support bracket is fastened to the foot end wall 18 by a pair of eye bolt/hand nut assemblies 60. A removable "T" shaped support board 62 having a stem portion 64 is inserted through the bracket 58 and the eye bolt/hand nut assemblies tightened to secure the support board 62 in place as is shown in FIG. 6.

Turning now to the head end of the exercise apparatus 10 in accordance with the invention, as shown in FIG. 1, the apparatus 10 may include a spaced pair of upright supports 66 fastened to the head end wall 16 which in turn carry a pair of pulleys 68. A pair of arm cords 70 pass through these pulleys. Each cord 70 has one end adjustably secured to a friction cleat 72 on the underside of the carriage 22 The other end of each cord 70 has a hand loop 74 for the user to grasp. When the user sits or lies on the carriage 22 and pulls on one or both of the cords 70, the carriage is pulled along the rails 20 toward the head end of the frame 12 against spring tension. The pulleys 68 may alternatively be mounted directly to the head end wall 16 as is shown in FIG. 2. Operation of the cords 70 remains the same as above described in this configuration.

A support rail member 76 is located at the head end of the frame 12, and is fastened to the inside of the end wall 16 just below its upper edge and above the pulleys 68. A series of spaced support pin members 78 are also mounted along the inside surface of the side walls 14 just below the upper edge of the side walls 14. These pins 78, the support rail 76 and the head end of the carriage base plate 24 provide support to a head end table top member 80 when it is placed on the apparatus 10 as is shown in FIGS. 4 and 5.

Figure 5:
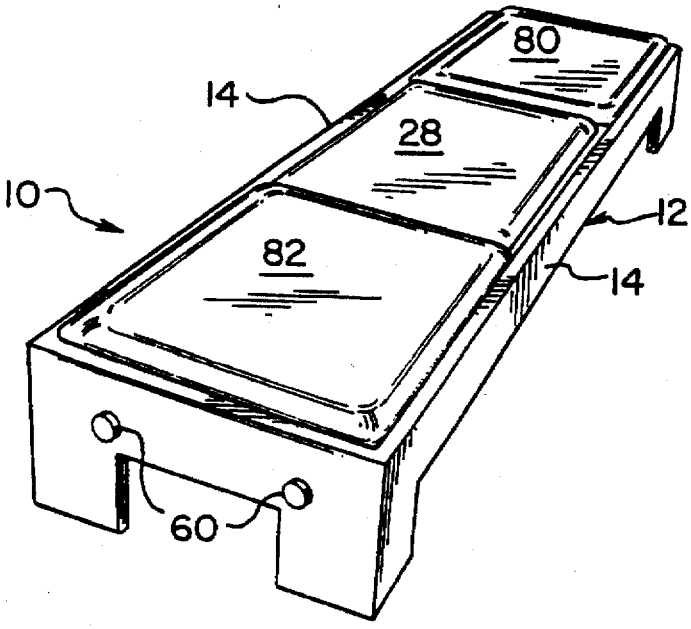
FIG. 5 is a perspective view of the apparatus in accordance with the present invention shown in FIG. 1 converted into an exercise table with the padded table top members installed on either side of the carriage.

A foot end table top member 82 can be removably positioned at the foot end of the exercise apparatus 10 as is shown in FIGS. 4 and 5 when the foot bar assembly 38 is folded as is shown in FIG. 6. When so positioned, the table top member 82 is supported on the exercise apparatus 10 by the horizontal bar 40, the upper edge of the T shaped support board 62 and the support members 42. Each of the table top members 80 and 82 are generally rectangular plates which have a covered foam padding on their upper surfaces. They are dimensioned to fit inside the frame 12 on either side of the carriage 22 so as to present a generally flat surface in the plane of the top of the carriage 22 as is shown in FIG. 5. The carriage 22 may be kept against the foot bar 40 by spring tension. However, the table top members 80 and 82 are also dimensioned to hold the carriage in a stationary position between the end walls 16 and 18.

Figure 7:
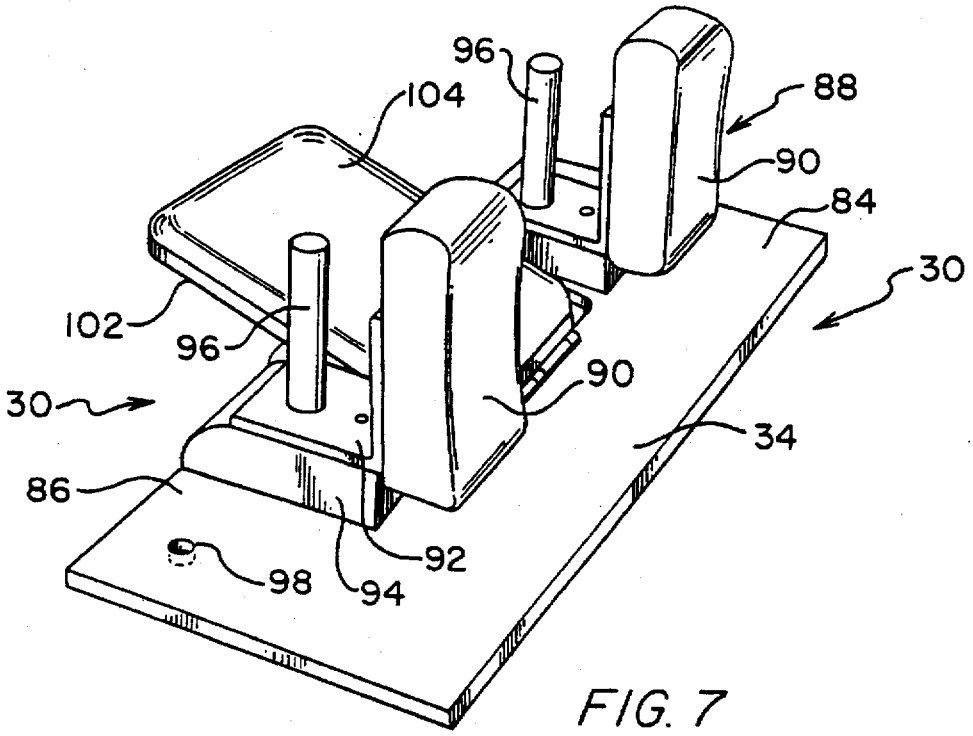
FIG. 7 is an enlarged perspective view of the shoulder stop and head rest assembly in accordance with the invention removed from the carriage of the exercise apparatus.

Turning now to FIG. 7, the shoulder stop and head rest assembly 30 is shown removed from the carriage 22 of the exercise apparatus 10. The shoulder stop and head rest assembly includes a generally flat, rectangular base plate 84 which has a mounting portion 86 and a tail portion 34. The mounting portion 86 supports a pair of spaced apart shoulder stops 88. Each stop 88 includes a curved pad 90 to receive the user's shoulder. The curved pad 90 is preferably mounted on an upright portion of an L shaped bracket 92 preferably made of a piece of aluminum right angle stock which is bolted to a riser block 94 which is in turn bolted to the mounting portion 86 of the base plate 84. The shoulder stops 88 each also includes an upright post 96 mounted on the horizontal portion of the bracket 92 over which one of the hand loops 74 may be placed for convenient storage. The tail portion 34 of the base plate 84 is sized to slip fit into the slot 32 between the base plate 24 and the top carriage platform 28. The mounting portion 86 of the base plate 84 also has a hole 98 adjacent each corner and positioned to align with a corresponding hole 100 in the base plate 24 of the carriage 22 for receiving the bolt and threaded knob assembly 36 to fasten the mounting portion 86 of the shoulder stop and head rest assembly 30 to the base plate 24 of the carriage 22.

Between the shoulder stops 88 is fastened an adjustable head rest 102. The head rest 102 is hinged to the mounting portion 86 of the base plate 84 and has a covered foam pad 104 on its upper surface to cushion the user's head. The head rest 102 may be moved between raised and lowered positions by positioning a spacer block (not shown) between the head rest 102 and the mounting portion 86. The spacer block is hinged to the underside of the head rest 102.

The exercise apparatus 10 in accordance with the invention can be converted easily between the stationary table as shown in FIG. 5 and the movable exercise apparatus shown in FIGS. 1 and 2. First the table top members 80 and 82 are removed and stored beneath the frame 12, and the foot support assembly 38 rotated out of the folded position toward the carriage 22 to the operational position as is shown in FIGS. 1 and 2. The user then installs the shoulder stop and head rest assembly 30 onto the carriage 22 by slipping the tail portion 34 of the assembly 30 into the slot 32 and installing the bolt and threaded knob assemblies 36 through the aligned holes 98 and 100. The hand loops 74 may then be looped over the posts 96 to position the arm cords 70 within easy reach when the user is reclined or sitting on the carriage 22.

The exercise apparatus of the invention can easily be converted back into a stationary table or bench by reversing the above steps, namely removing the hand loops 74 from the posts 96, unfastening the bolt and threaded knob assemblies 36, removing the shoulder and head rest assembly 30, folding the adjustable foot support assembly 38 down into the frame 12 with the carriage 22 against the horizontal bar 40, installing the foot end table top member 82, and finally installing the head end table top member 80 against the other end of the carriage top padded platform 28.

The convertible exercise apparatus in accordance with the present invention has been described above with reference to a particular preferred embodiment thereof. However, it is to be understood that the present invention may be practiced other than as specifically described. For example, and not by way of limitation, the frame 12 may be made of wood or may be metal or plastic and may be other than rectangular in shape. The foot support assembly 38 may be a hinged flat platform rather than a bar arrangement. The carriage 22 may slide on low friction sliders rather than rollers. The shoulder stop and head rest assembly 30 may be constructed differently than as shown and described. The shoulder stops 88 may be adjustably positioned and secured to the base plate 84 via slots so that users having differing shoulder widths may be accommodated more comfortably on the exercise apparatus 10. The fasteners 36 and 60 utilized on the apparatus may also be other than as specifically described. The support pins members 56 and 78 may be metal pins, wood strips or blocks, brackets or other devices to perform the same function. The table top members 80 and 82 may alternatively be formed with peripheral flanges to fit over and rest on the top edges of the frame 12 rather than being sized to fit fully within the frame 12. Accordingly, it is intended to embrace all such changes, modifications, and variations that fall within the spirit and broad scope of the appended claims. All patents, patent applications, and other publications cited herein are incorporated by reference in their entirety.

What is claimed is:

1. A convertible movable carriage exercise apparatus comprising:

a generally rectangular frame having a head end and a foot end;

a movable carriage mounted on said frame for movement between said head and foot ends, said carriage including a base plate, a spacer mounted on said base plate, and a top platform member shorter than said base plate mounted on said spacer forming a horizontal slot between said top platform member and said base plate, and a removable shoulder stop and head rest assembly for preventing a user's body from sliding from said carriage during recumbent exercise, said assembly including a base member having a tail portion insertable into said slot between said base plate and said top platform member;

a foot support assembly pivotally mounted to said frame near said foot end;

a head end table top member removably positionable between said head end of said frame and said carriage when said shoulder stop and head rest assembly is removed from said carriage; and a foot end table top member removably positionable between said foot end of said frame and said carriage wherein said top members cooperate to fix said movable carriage in a stationary position on said frame when said top members are positioned between said ends and said carriage to form a generally flat stationary table.

2. The apparatus according to claim 1 wherein said table top members are generally rectangular plate members each having a padded upper surface.

3. The apparatus according to claim 1 wherein said foot support assembly is pivotable between an upright operating position and a horizontal storage position within said frame.

4. The apparatus according to claim 3 wherein said foot end table top member is supported in said frame by said foot support assembly in said storage position.

5. An exercise apparatus comprising, in combination, a frame, a movable carriage for supporting a user's body on said frame, said carriage comprising a generally rectangular base plate having a first end and a second end, a spacer mounted on said base plate, and a generally rectangular top platform member shorter than said base plate of said carriage secured to said spacer and positioned over said base plate, a portion of said first end of said base plate extending beyond said top platform member, said top platform member and said base plate defining an open slot across said base plate adjacent said portion of said first end of said base plate, said carriage being movable against a resistance force along guide rails mounted on said frame, a foot support assembly mounted at a foot end of said frame, and a removable shoulder stop and head rest assembly mounted on said carriage having a pair of spaced upright shoulder stops and a head rest mounted between said stops whereby a user can recline on said carriage with his head on said head rest and shoulders against said stops and push his feet against said foot support assembly to move said carriage against said resistance force, said removable shoulder stop and head rest assembly comprising a generally flat base member having a mounting portion for supporting a pair of spaced shoulder stops and a head rest therebetween and a tail portion adapted to fit within said open slot at said first end of said carriage.

6. The apparatus according to claim 5 further comprising said base plate and said base member each having at least one aligned hole therethrough for receiving a fastener assembly to secure said shoulder stop and head rest assembly to said base plate of said carriage.

7. The apparatus according to claim 5 further comprising a generally flat head end table top member positionable adjacent said carriage and between said carriage and a head end of said frame when said shoulder stop and head rest assembly is removed from said carriage, and a generally flat foot end table top member positionable between said carriage and a foot end of said frame to secure said carriage in a stationary position on said rails thereby forming a stationary exercise table.

8. An exercise apparatus comprising, in combination, a frame, a movable carriage for supporting a user's body on said frame, said carriage being movable against a resistance force along guide rails mounted on said frame, a foot support assembly mounted at a foot end of said frame, and a removable shoulder stop and head rest assembly mounted on said carriage having a pair of spaced upright shoulder stops and a head rest mounted between said stops whereby a user can recline on said carriage with his head on said head rest and shoulders against said stops and push his feet against said foot support assembly to move said carriage against said resistance force, a generally flat head end table top member positionable adjacent said carriage and between said carriage and a head end of said frame when said shoulder stop and head rest assembly is removed from said carriage, and a generally flat foot end table top member positionable between said carriage and a foot end of said frame to secure said carriage in a stationary position on said rails thereby forming a stationary exercise table, said carriage comprising a generally rectangular base plate having a first end and a second end, a spacer mounted on said base plate, and a generally rectangular top platform member shorter than said base plate of said carriage secured to said spacer and positioned over said base plate, a portion of said first end of said base plate extending beyond said top platform member, said top platform member and said base plate defining an open slot across said base plate adjacent said portion of said first end of said base plate, wherein said removable shoulder stop and head rest assembly comprises a generally flat base member having a mounting portion for supporting a pair of spaced shoulder stops and a head rest therebetween and a tail portion adapted to fit within said open slot at said first end of said carriage.

9. The apparatus according to claim 8 further comprising said base plate and said base member each having at least one aligned hole therethrough for receiving a fastener assembly to secure said shoulder stop and head rest assembly to said base plate of said carriage.

* * * * *